US007401701B2

(12) United States Patent
Daitch

(10) Patent No.: US 7,401,701 B2
(45) Date of Patent: Jul. 22, 2008

(54) MULTI-COMPARTMENT PACKAGE ATTACHMENT APPARATUS AND METHOD

(76) Inventor: Diana Daitch, 1465 C St., #3613, San Diego, CA (US) 92101

( * ) Notice: Subject to any disclaimer, the term of this patent is extended or adjusted under 35 U.S.C. 154(b) by 22 days.

(21) Appl. No.: 11/473,454

(22) Filed: Jun. 22, 2006

(65) Prior Publication Data

US 2006/0289325 A1 Dec. 28, 2006

Related U.S. Application Data

(60) Provisional application No. 60/692,900, filed on Jun. 22, 2005.

(51) Int. Cl.
*B65D 81/26* (2006.01)

(52) U.S. Cl. ..... 206/460; 206/541; 206/542; 206/549; 53/445

(58) Field of Classification Search ..... 206/232, 206/460, 542, 545, 549, 541, 553, 806; 220/505; 53/410, 445; 426/124
See application file for complete search history.

(56) References Cited

U.S. PATENT DOCUMENTS

| | | | | | |
|---|---|---|---|---|---|
| 3,376,974 | A * | 4/1968 | Hilliard | 206/217 |
| 3,435,868 | A * | 4/1969 | Stermer | 206/455 |
| 4,138,014 | A * | 2/1979 | Bouman | 206/542 |
| 4,804,137 | A | 2/1989 | Harby | |
| 4,930,637 | A * | 6/1990 | DeRoseau | 206/541 |
| 4,993,845 | A * | 2/1991 | Faltynek | 383/40 |
| 5,077,050 | A | 12/1991 | Wall | |
| 5,351,851 | A * | 10/1994 | Powell | 220/503 |
| 5,590,783 | A * | 1/1997 | Capy et al. | 206/542 |
| 5,842,631 | A | 12/1998 | Berger | |
| 5,851,069 | A * | 12/1998 | Davoren | 383/38 |
| 6,173,833 | B1 * | 1/2001 | Strehlow | 206/216 |
| 6,254,907 | B1 * | 7/2001 | Galomb | 426/115 |
| 6,364,112 | B1 | 4/2002 | Pitschka | |
| 6,419,153 | B1 * | 7/2002 | Maita | 229/400 |
| 6,719,140 | B1 * | 4/2004 | Rinsler | 206/541 |
| 6,415,940 | B1 | 7/2005 | Brabson, II | |
| 2002/0197098 | A1 * | 12/2002 | Palmer | 402/79 |
| 2003/0213707 | A1 * | 11/2003 | Clay | 206/217 |
| 2004/0217022 | A1 * | 11/2004 | Irvine et al. | 206/223 |
| 2005/0052015 | A1 | 3/2005 | Hynek | |

* cited by examiner

*Primary Examiner*—David T Fidei
(74) *Attorney, Agent, or Firm*—Dalina Law Group, P.C.

(57) ABSTRACT

A multi-compartment package attachment apparatus and method for coupling a plurality of items with a package, for example a food package. Printed items such as marketing materials or promotional flyers may be inserted into a first compartment while condiments, napkins, hand-wipes or utensils may be inserted into one or more other compartments. The apparatus may then be fixedly coupled with another package and may also cover or hold prizes for example. One or more compartments may comprise thermal protective layers to keep condiments from melting when hot food packages are stacked. Thermochromic materials may be used to show temperatures of items in compartments. Each compartment may utilize any technique for enclosing an item. Embodiments may be constructed from materials that allow underlying package branding to be visible when the embodiment is coupled with the package or may be coupled to an area of a package not covering existing branding.

3 Claims, 9 Drawing Sheets

MULTI-COMPARTMENT PACKAGE ATTACHMENT APPARATUS AND METHOD

This application takes benefit from U.S. Provisional Patent Application Ser. No. 60/692,900, filed Jun. 22, 2005 entitled "MULTI-COMPARTMENT PACKAGE ATTACHMENT APPARATUS AND METHOD", the specification of which is hereby incorporated herein by reference.

BACKGROUND OF THE INVENTION

1. Field of the Invention

Embodiments of the invention described herein pertain to the field of packaging. More particularly, but not by way of limitation, one or more embodiments of the invention enable items to be packaged in a plurality of compartments and coupled with another package.

2. Description of the Related Art

There is no known apparatus that enables the coupling of multiple items such as marketing materials, condiments, napkins or utensils to a package, for example a food package. For instance in situations where delivery personnel supply food items to customers, there is no easy way to attach a plurality of items intended for an end customer. For example there is no known device that allows for attaching cheese or peppers along with a promotional flyer to a pizza box. In this example, a delivery person may or may not remember to provide the customer with these items and therefore, missed marketing opportunities occur. In this scenario, customers are not provided with the items that they need to complete the act of eating the package food item.

Delivery personal that physically transport the packages are ill equipped to perform marketing for a company since many of the delivery personnel are low paid, unskilled workers. When a worker is directed to deliver a package, for example a package that contains food, the worker is generally paid for each delivery and does not have an incentive to provide materials other than the item to be delivered. The delivery of condiments (such as parmesan cheese or hot peppers for example) and napkins is inconsistent since these items are not physically coupled with the package that is being delivered. When a delivery worker is in a rush, these items may be haphazardly delivered or not delivered at all.

Coupons, prizes or promotional materials are generally not delivered with packaged items, and when these items are intended for delivery, they may also go undelivered, especially when the delivery worker is under pressure to transport a number of items in a short period of time. In addition to the problem of delivery or non-delivery of items other than the actual packaged item, delivery of multiple items simply makes each delivery harder. For example, a worker that has half of a dozen salads to deliver with napkins and salt/pepper and hand-wipes may forget many of these items since there are so many separate items to carry. These delivery problems make the end user's experience sub-optimal and causes further work for the delivery center since some customers may call in and complain. Other customers may simply not order from establishments that have good food since the end experience also depends on the items delivered along with the food.

For at least the limitations described above there is a need for a multi-compartment package attachment apparatus and method.

SUMMARY OF THE INVENTION

One or more embodiments of the invention provide a multi-compartment package attachment apparatus and method for coupling a plurality of items with a package, for example a food package. In one embodiment of the invention printed items such as marketing materials or promotional flyers may be inserted into a first compartment while condiments, napkins, hand-wipes or utensils may be inserted into one or more other compartments. The apparatus may be coupled with another package and may also cover or hold prizes for example. One or more compartments of the apparatus may comprise thermal protective layers to keep condiments from melting when hot food packages are stacked. Each compartment may utilize any technique for enclosing an item.

The method for utilizing one or more embodiments of the invention comprise obtaining an attachable package having a plurality of compartments and inserting a printed object in one compartment and inserting a condiment, napkin, hand-wipe or utensil in one or more compartments and coupling the apparatus to another package.

One or more embodiments of the invention may comprise compartments that are configured to hold a particular type of item. For example, one compartment may be configured to hold a printed sheet of paper or half sheet of paper. The compartment holding the sheet or paper or half sheet of paper may for example be sized to hold a 8.5 by 11 inch piece of paper or half sheet of this size paper. Another embodiment may hold an A4 sized sheet of paper or half sheet of this size paper. Any other size or fraction of paper may be utilized including but not limited to paper that is of a particular size and that is folded one or more times. In one or more embodiments of the invention the compartment may be slightly larger than the paper or folded paper enable easy insertion and removal of the paper.

Embodiments of the invention may comprise scratch off or hidden prizes such as toys that are either in a particular compartment or that lie between the apparatus and the package to which the apparatus is coupled. By utilizing prizes or promotional surprises, sales levels may increase which may yield higher profits for a company utilizing one or more embodiments of the invention. Given two choices between a pizza delivery that has small toys for the kids and one that doesn't may provide a competitive advantage for subsequent orders.

Each compartment may also be configured with different thicknesses depending upon the item that is intended to be stored in the given compartment. For example, a compartment that is to hold cheese for example may be constructed from a thermally insulating material or may hold an insert that is thermally insulting into which the cheese is to be held so that it does not melt.

One or more embodiments of the invention may utilize color changing plastic for example to allow a user to observe how hot the package is. This allows for the indirect determination of the temperature inside the package. Any type of thermochromic material that reversibly changes color based on temperature may be utilized in embodiments of the invention.

Compartments may comprise openings that are serrated, linearly cut and may or may not overlap. Any other type of opening may be utilized including ZIPLOC® style openings or adhesive openings for example. Other embodiments of the invention may utilize tear off compartments so that portions of the multi-compartment attachment may be saved for later use. For example when a user has received a condiment that they do not desire to consume at a particular time, the user may remove that portion of the multi-compartment attachment for later use. This for example allows a user to save cheese or napkins or any other attached item for later use and thus allows for a more efficient use of natural resources by limiting the waste of attached items.

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION OF THE INVENTION

A multi-compartment package attachment apparatus and method will now be described. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

One or more embodiments of the invention provide a multi-compartment package attachment apparatus and method for coupling a plurality of items with a package, for example a food package. One skilled in the art will readily appreciate that the apparatus and method described herein are not limited to packaged food but rather may be utilized on any packaged item. It will also be readily appreciated that one or more embodiments of the invention may be pre-loaded or loaded at the point of filling the attached package.

Figure 1:
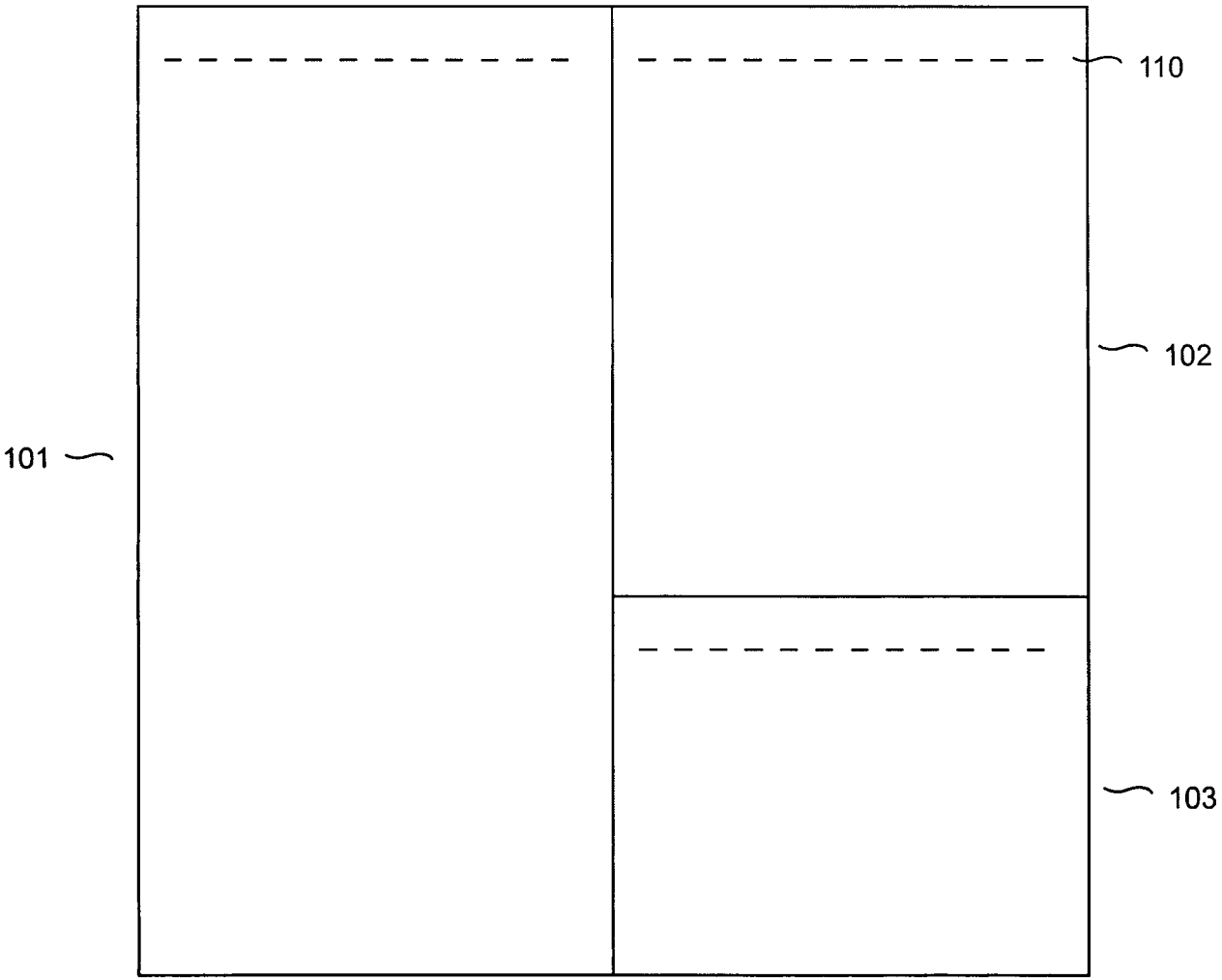
FIG. 1 illustrates a top view of an embodiment of the invention for use with pizza packages.

FIG. 1 shows a top view of an embodiment of the invention that is configured for coupling with a food package that holds pizza. One or more embodiments may be constructed from a material that allows underlying package branding to be visible when the embodiment is coupled with the package. Alternatively, embodiments of the invention may be coupled to an area of a package that does not cover existing branding. Printed items such as marketing materials or promotional flyers may be inserted into first compartment 101 while condiments for example pepper flakes packets, salt and pepper packets, or parmesan cheese packets may be inserted into compartment 102, napkins, hand-wipes or utensils may be inserted into compartment 103 for example. The apparatus may be coupled with another package and may also cover or hold prizes for example. Compartment 101 for example may hold a prize under the promotional flyer that is exposed when the flyer is removed for example. In another embodiment, compartment 103 may hold a surprise underneath the items placed in compartment 103. One or more compartments, such as compartment 102, may comprise thermal protective layers to keep condiments from melting when hot food packages are stacked. Thermochromic materials may be utilized to indicate the temperature of the item inside a compartment. For example a thermochromic plastic may be utilized to visually indicate a color to signify that cheese in a compartment is cold for example and another color to indicate that the cheese is warm.

Each compartment may utilize any technique for enclosing an item. Opening 110 for example shows that the openings may be pulled apart to allow for inserting an item through opening 110 into compartment 102. The opening may be serrated, linearly cut and may or may riot overlap. Any other type of opening may be utilized including ZIPLOC® style openings or adhesive openings for example. In other embodiments of the invention, the opening may be completely free, for example opening 110 may be placed at the top of the compartment without serrations so that the compartment is in effect open. In this embodiment, items that are placed in the compartment may use the compressive force of the plastic for keeping the items within the compartment.

Figure 2:
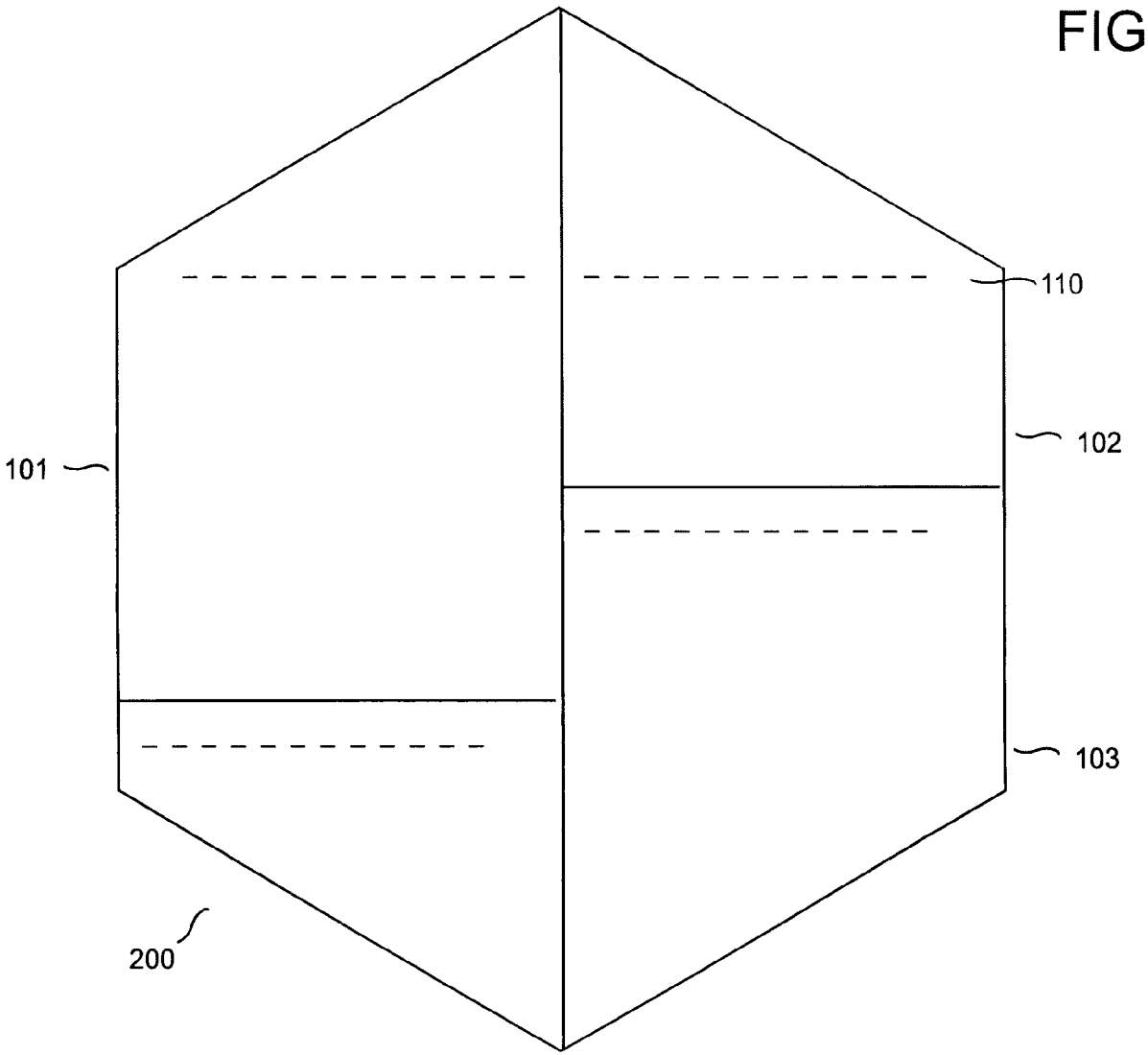
FIG. 2 illustrates a top view of another embodiment of the invention for use with salad packages.

FIG. 2 shows a top view of an embodiment of the invention that is configured for coupling with a food package that holds salad. In this example, the package is hexagonal and the embodiment of the invention is configured to fit the package. This is not a requirement of the apparatus and this example is shown as an embodiment that maximizes the amount of compartmentalized space for the generally small food package to which the apparatus is coupled. Printed items such as marketing materials or promotional flyers may be inserted into first compartment 101 while condiments may be inserted into compartment 102, napkins, hand-wipes or utensils may be inserted into compartment 103 for example. Compartment 200 is shown beneath compartment 101 and allows for other items such as packets of salad dressing or croutons to be held by the apparatus for example although any other item may be substituted for these items. There is no requirement that each item be placed in the exact compartment that is described herein as the described configurations are exemplary only.

Figure 3:
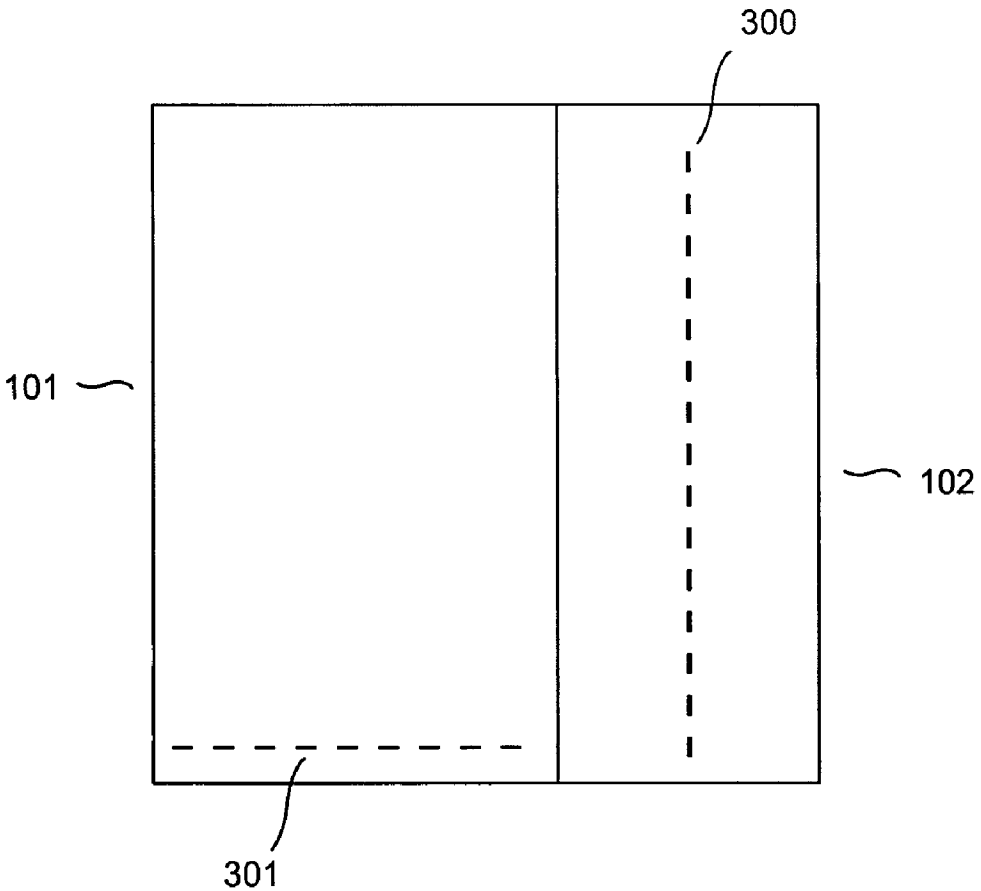
FIG. 3 illustrates a top view of another embodiment of the invention for use with sandwich packages.

FIG. 3 shows a top view of an embodiment of the invention that is configured for coupling with a food package that holds a sandwich or other food item smaller than a pizza box. In this example, the package is square and the embodiment of the invention is configured to fit the package. This is not a requirement of the apparatus and this example is shown as an embodiment that maximizes the amount of compartmentalized space for the generally small food package to which the apparatus is coupled. Printed items such as marketing materials or promotional flyers may be inserted into first compartment 101 while condiments, napkins, hand-wipes or utensils may be inserted into compartment 102 for example. In this embodiment opening 300 is vertically aligned and opening 301 is horizontally aligned and configured on the lower portion of the apparatus. Any position or orientation of openings is in keeping with the spirit of the invention.

Figure 4:
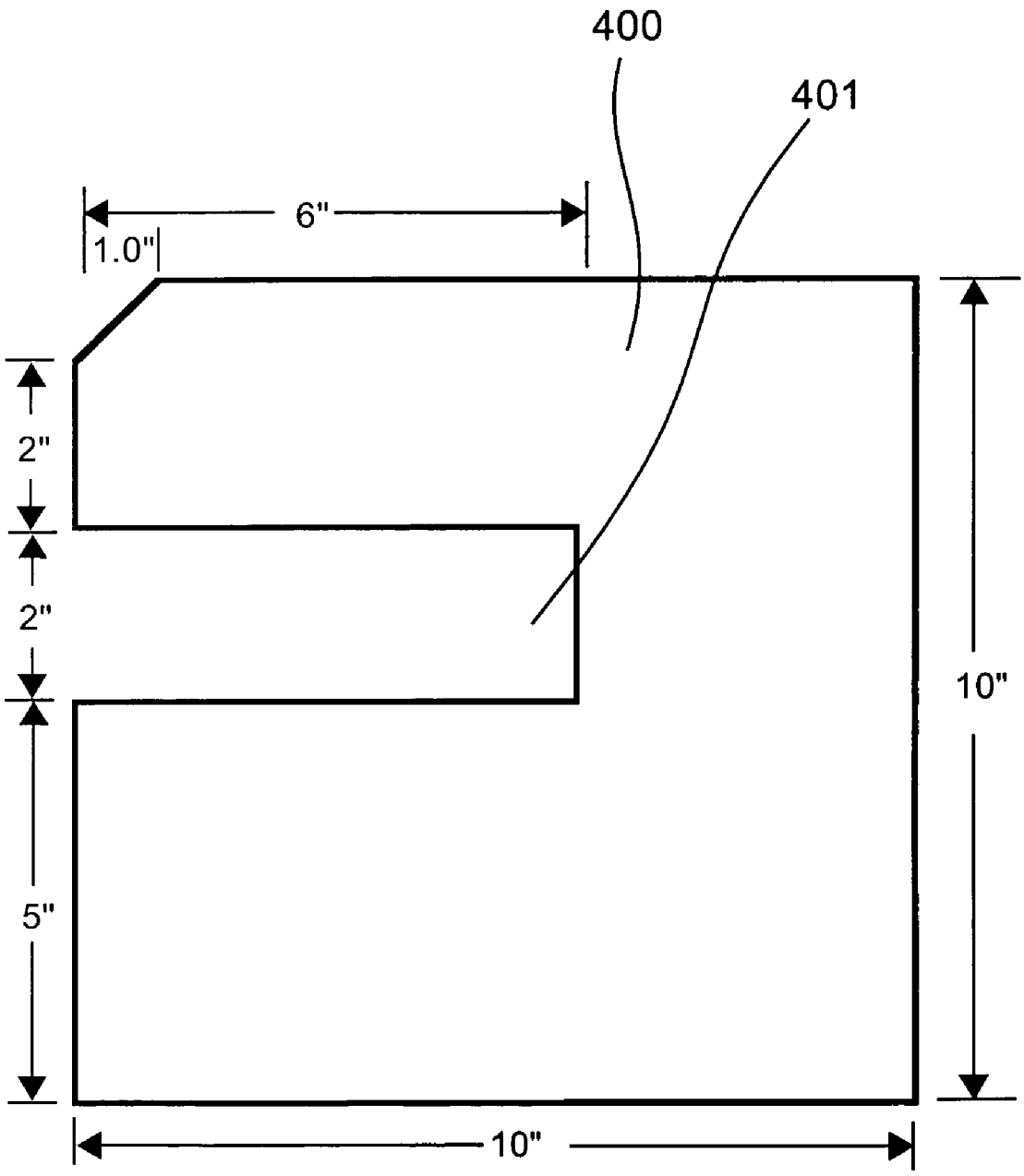
FIG. 4 illustrates a top view of a top portion embodiment for use with pizza packages.
Figure 7:
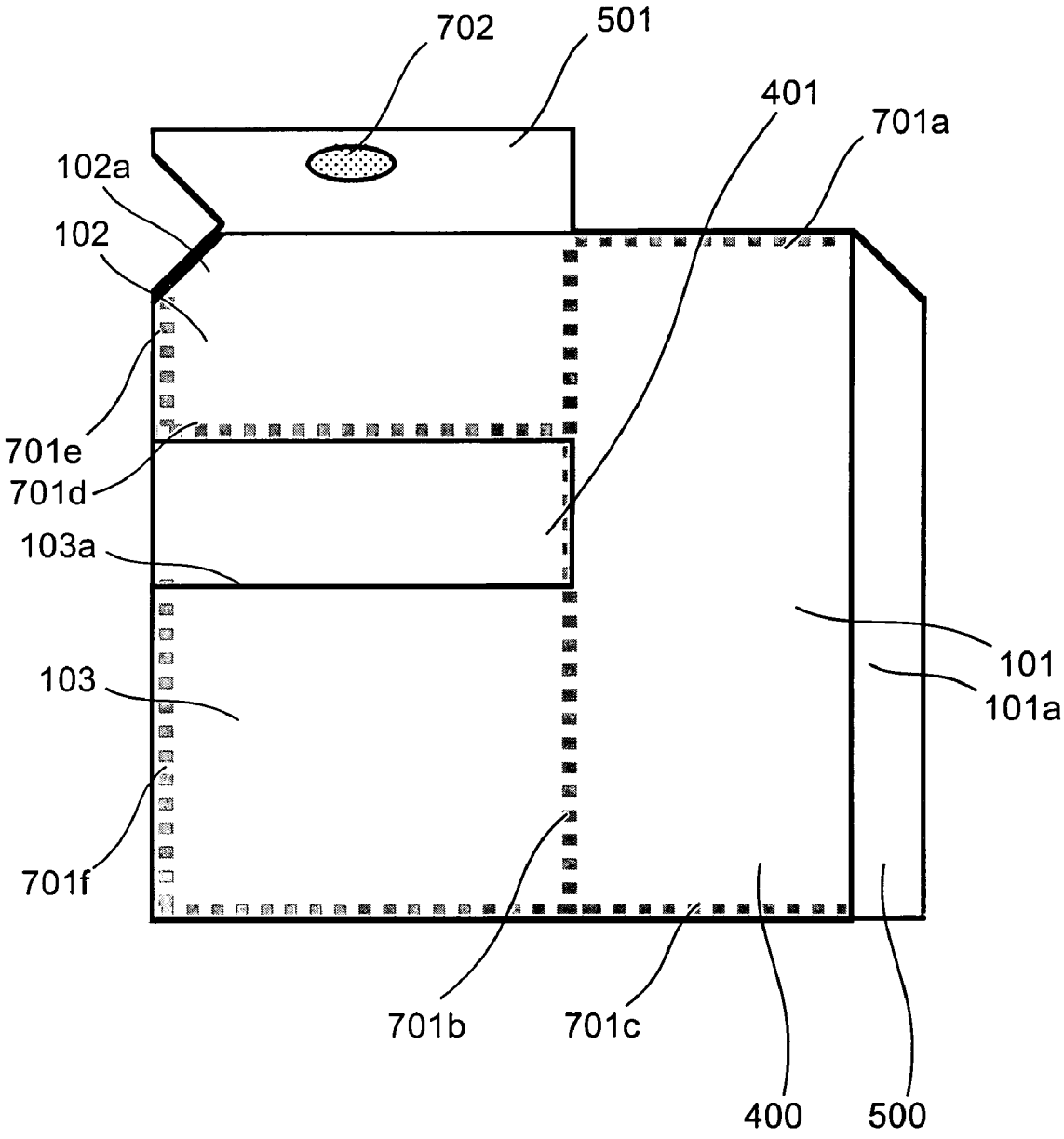
FIG. 7 illustrates a top view of an assembled top portion and bottom portion embodiment for use with pizza packages.

FIG. 4 illustrates a top view of top portion embodiment 400 for use with pizza packages. This portion is coupled with the bottom portion embodiment of FIG. 5 in manufacturing the completed embodiment as shown in FIG. 7. Top portion embodiment 400 comprises cutout 401 in this embodiment. Cutout 401 allows for a compartment to be accessed or to allow for marketing logos to show through the completed embodiment. The measurements given fit a standard pizza box and as one skilled in the art will recognize, the measurements may be altered without deviating from the spirit of the invention.

Figure 5:
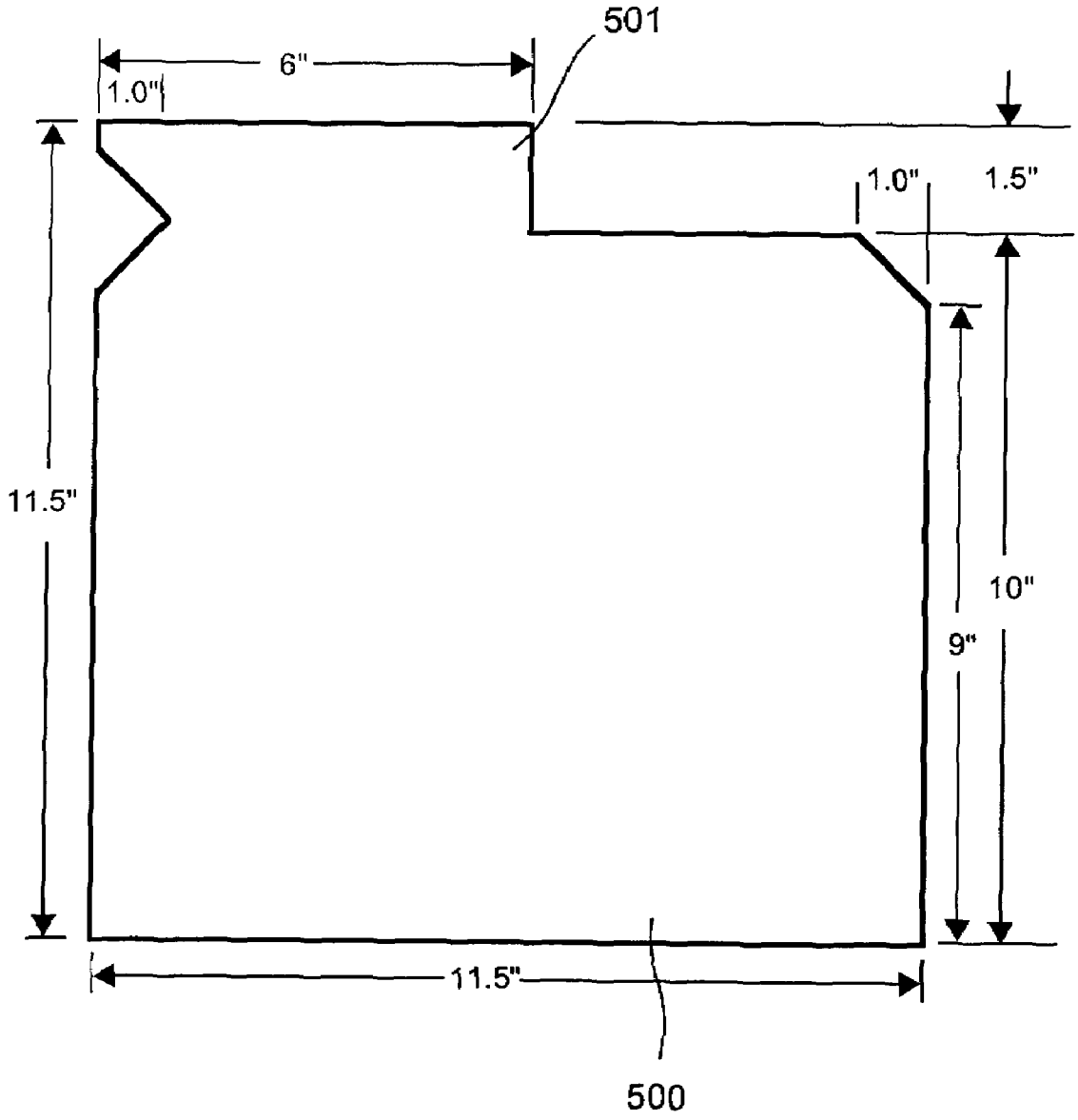
FIG. 5 illustrates a top view of a bottom portion embodiment for use with pizza packages.

FIG. 5 illustrates a top view of bottom portion embodiment 500 for use with pizza packages. This portion is situated beneath top portion embodiment 400 to create a backing for top portion embodiment 400 that is shown in FIG. 4. Bottom portion embodiment 500 is slightly larger than top portion embodiment 400 and allows for ease of coupling top portion embodiment 400 to bottom portion embodiment 500. Fold over flap 501 is optional and is shown with a notch on the upper left portion the minimum horizontal thickness of which is folded to enclose a compartment.

Figure 6:
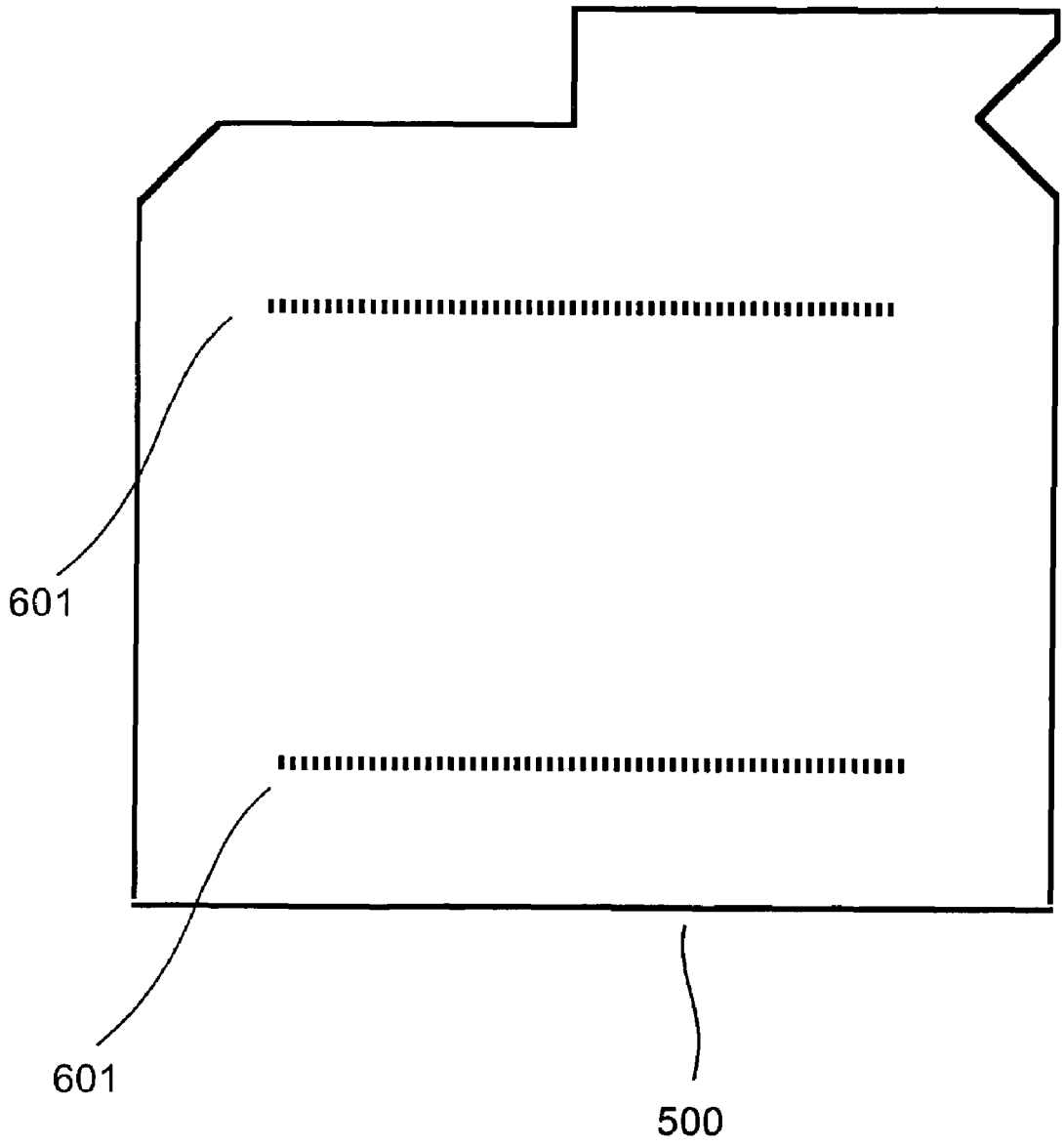
FIG. 6 illustrates a bottom view of a bottom portion embodiment for use with pizza packages.

FIG. 6 illustrates a bottom view of a bottom portion embodiment for use with pizza packages. Coupling strips 601 may comprise glue strips or any other mechanism for coupling the bottom of bottom portion to a food container such as a pizza box for example. In one embodiment glue strips may be used as coupling strips 601 which have a removable back to expose the glue.

FIG. 7 illustrates a top view of an assembled top portion and bottom portion embodiment for use with pizza packages. Top portion embodiment 400 is coupled with bottom portion embodiment 500 via coupling 701*a*-701*f*. In one embodiment, coupling 701*a*-701*f* is a heat seal coupling. In another embodiment of the invention, coupling 701*a*-701*f* is an adhesive coupling. Any method of coupling top portion embodiment 400 to bottom portion embodiment 500 is in keeping with the spirit of the invention. In this completed embodiment compartment 101 is formed by coupling top portion embodiment 400 to bottom portion embodiment 500 via coupling 701*a*, 701*b* and 701*c*. These couplings seal off compartment 101 from the rest of the apparatus. Opening 101*a* allows for objects to be placed in compartment 101. The portion of bottom portion embodiment 500 that extends to the right that is not covered by top portion embodiment 500 may be folded over to form a seal of compartment 101 in one or more embodiments of the invention. In other embodiments, compartment 101 is left open. Compartment 102 is formed by coupling top portion embodiment 400 to bottom portion embodiment 500 via coupling 701*b*, 701*d* and 701*e*. These three couplings form three sides of compartment 102 and seal the compartment from the rest of the apparatus. Fold over flap 501 may be folded over and held in place by coupling 702, which in one or more embodiments is an adhesive coupling such as a glue strip. Opening 102*a* allows for objects to be placed in compartment 102. Compartment 103 is formed by coupling top portion embodiment 400 to bottom portion embodiment 500 via coupling 701*b*, 701*c* and 701*f*. These three couplings form three sides of compartment 103 and allow for objects to be held in place therein. Opening 103*a* is a free opening that is not configured to be sealed in this embodiment. Cutout 401 allows for the insertion and removal of objects from compartment 103 and allows for bottom portion embodiment 500 to be seen. In embodiments where bottom portion embodiment 500 is clear, then any marketing logo beneath cutout 401 shows through bottom portion embodiment 500, for example a pizza company logo. Any of the compartments may be removed from the apparatus if compartments 101, 102 and 103 are configured with serrations for example along couplings 701*a*-701*f*. In addition, compartments 101, 102 and 103 may individually be heat insulated or may comprise thermochromic materials. Compartments 101, 102 and 103 may make use of scratch-off areas, or contain prizes as well.

Figure 8:
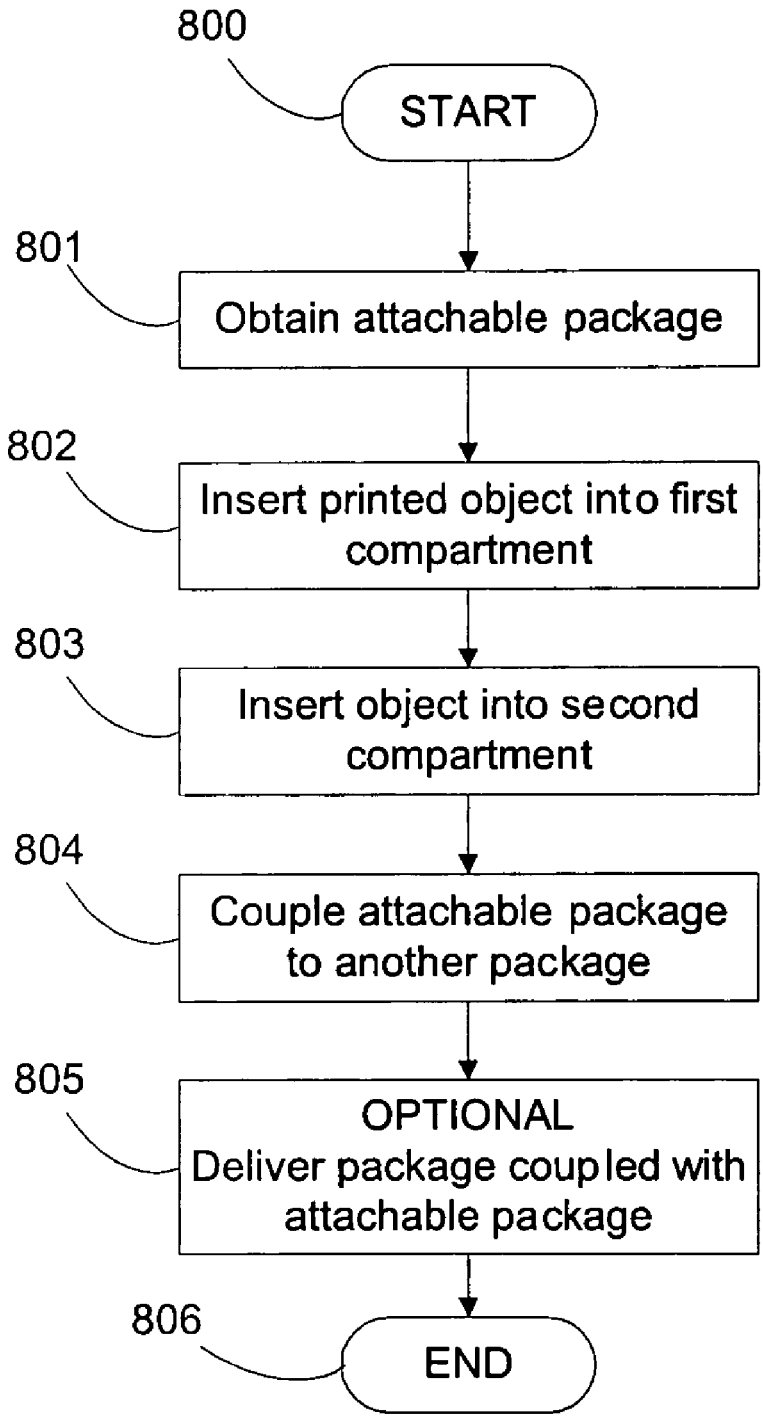
FIG. 8 illustrates a flow chart of an embodiment of the method for utilizing a multi-compartment package attachment.

FIG. 8 shows one embodiment of a method for utilizing a multi-compartment attachment for a package. The method for utilizing one or more embodiments of the invention starts at 800 and comprises obtaining an attachable package comprising a plurality of compartments at 801. The method further comprises inserting a printed object in one compartment at 802 and inserting another object such as a condiment, napkin, hand-wipe or utensil in another compartment at 803. The method further comprises coupling the apparatus to another package at 804. Optionally, the package may be delivered at 805. Processing ends at 806.

Figure 9:
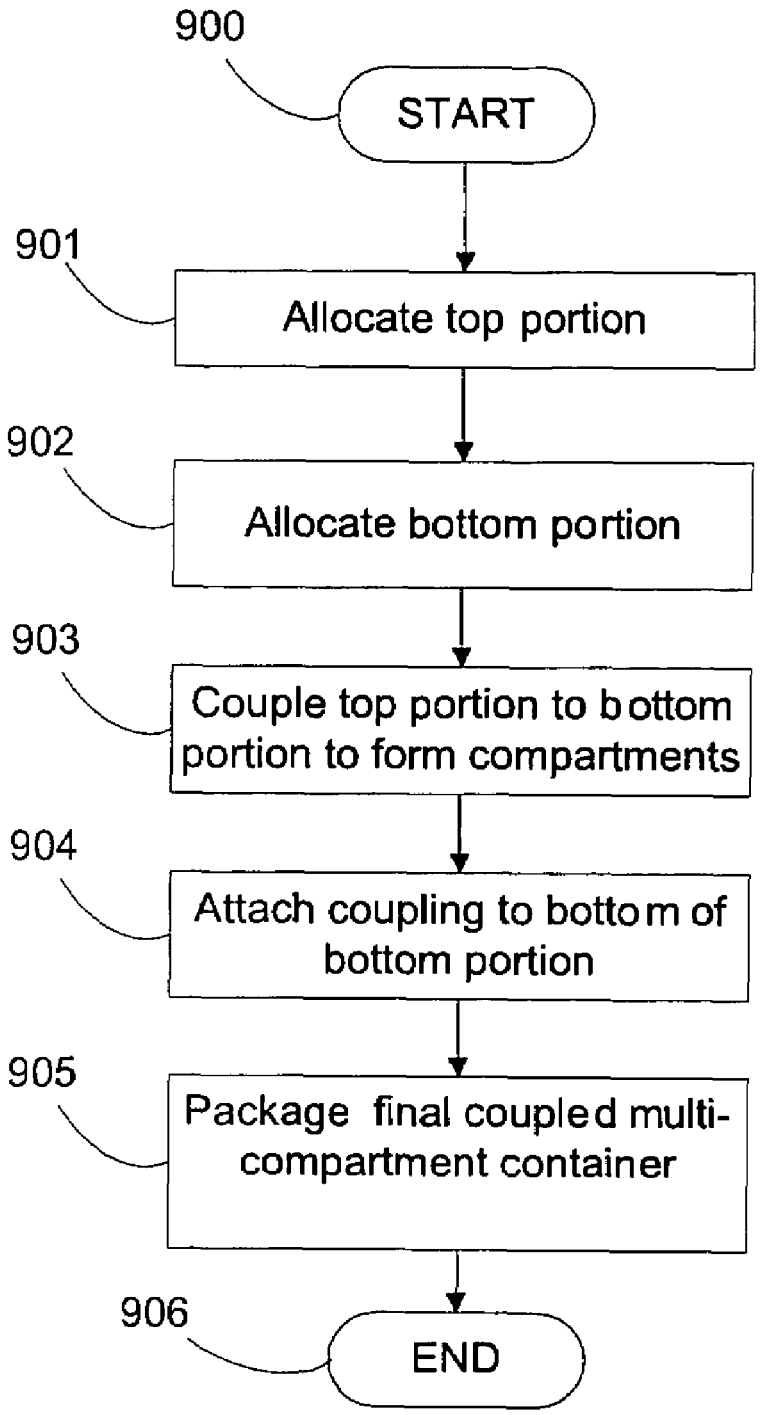
FIG. 9 illustrates a flow chart of an embodiment of the method for manufacturing a multi-compartment package attachment.

FIG. 9 illustrates a flow chart of an embodiment of the method for manufacturing a multi-compartment package attachment. The method for manufacturing an embodiment of the invention begins at 900. The top portion is allocated at 901 and the bottom portion is allocated at 902. The allocation steps may involve rolling sheets of PVC or other type of plastic, for example 0.035" thick through an area that heat welds couplings 701*a*-701*f* for example. In another embodiment of manufacture, the allocation process involves placing a pre-cut top portion and bottom portion against each other in preparation for coupling the top and bottom portion with each other. The top and bottom portion are coupled at 903. This may involve heat welding or gluing the top and bottom portion together in a way that leaves accessible compartments in the finished multi-compartment container. A coupling is attached to the bottom of the bottom portion at 904 and this allows for the finished multi-compartment container to be coupled with a food container such as for example a pizza box. The finished multi-compartment container may then be packaged at 905 for shipment. Processing ends at 906.

One or more embodiments of the invention may comprise compartments that are configured to hold a particular type of item. For example, one compartment may be configured to hold a printed sheet of paper or half sheet of paper. The compartment holding the sheet or paper or half sheet of paper may for example be sized to hold a 8.5 by 11 inch piece of paper or half sheet of this size paper. Another embodiment may hold an A4 sized sheet of paper or half sheet of this size paper. Any other size or fraction of paper may be utilized including but not limited to paper that is of a particular size and that is folded one or more times. Although the larger compartments are shown in FIGS. 1-3 as holding promotional flyers, any of the compartments may be utilized for this method.

Embodiments of the invention may comprise scratch off or hidden prizes that are either in a particular compartment or that lie between the apparatus and the package to which the apparatus is coupled. By utilizing prizes or promotional surprises, sales levels may increase which may yield higher profits for a company utilizing one or more embodiments of the invention. The competitive field of food delivery is a field that benefits from every strategic advantage including those enabled by embodiments of the invention described herein.

Each compartment may also be configured with different thicknesses depending upon the item that is intended to be stored in the given compartment. For example, a compartment that is to hold cheese for example may be constructed from a thermally insulating material or may hold an insert that is thermally insulting into which the cheese is to be held so that it does not melt. Cooling compartments may also be utilized in order to keep one compartment cool or cold, while keeping another warm or hot depending on the intended item to be delivered in the respective compartment.

One or more embodiments of the invention may utilize temperature sensitive color changing plastic for compartments, e.g., a thermochromic material. For example this type of material allows a user to determine how hot a package is through visual observation. This allows for the indirect determination of the temperature inside the package without requiring a thermometer lead placed inside a package. In addition, messages that appear when the particular material is beyond a particular temperature, beneath a particular temperature, or both messages may appear based at each threshold allowing for multiple messages to be temperature based. One skilled in the art will recognize that the embodiments listed herein may be used for applications other than food delivery, such as but not limited to chemical or medical packaging as well.

Other embodiments of the invention may utilize tear off compartments so that portions of the multi-compartment attachment may be saved for later use. For example when a user has received a condiment that they do not desire to consume at a particular time, the user may remove that portion of the multi-compartment attachment for later use. This for example allows a user to save cheese or napkins or any other attached item for later use and thus allows for a more efficient use of natural resources by limiting the waste of attached items. Embodiments of the invention may then be advertised as Green or environmentally friendly packaging Any method of coupling a multi-compartment attachment to a package may be utilized in one or more embodiments of the invention. Adhesive, static electricity, VELCRO®, staples, tape, snaps, buttons, line, string, epoxy or any other method for example may be utilized for coupling.

While the invention herein disclosed has been described by means of specific embodiments and applications thereof, numerous modifications and variations could be made thereto by those skilled in the art without departing from the scope of the invention set forth in the claims.

What is claimed is:

1. A multi-compartment package attachment comprising:

a top portion of plastic;

a bottom portion of plastic wherein said top portion of plastic and said bottom portion of plastic are coupled to each other and wherein said bottom portion comprises a coupling element configured to couple said multi-compartment package attachment to a food package wherein said coupling element is selected from the group consisting of adhesive, static electricity, hook and loop, staples, tape, snaps, buttons, line, string and epoxy;

a plurality of compartments formed between said top portion of plastic and said bottom portion of plastic wherein said plurality of compartments form an attachable package having said coupling element;

a first compartment selected from said plurality of compartments wherein said first compartment is configured to hold at least a printed item of letter sized or A4 sized paper or folded printed item an integral fractional size of said letter sized or A4 sized paper;

a second compartment selected from said plurality of compartments wherein said second compartment is configured to hold at least a condiment, napkin, hand-wipe or utensil; and, wherein said second compartment may be removed from said multi-compartment package.

2. A multi-compartment package attachment comprising:

a top portion of plastic;

a bottom portion of plastic wherein said top portion of plastic and said bottom portion of plastic are coupled to each other and wherein said bottom portion comprises a coupling element configured to couple said multi-compartment package attachment to a food package wherein said coupling element is selected from the group consisting of adhesive, static electricity, hook and loon, staples, tape, snaps, buttons, line, string and epoxy;

a plurality of compartments formed between said top portion of plastic and said bottom portion of plastic wherein said plurality of compartments form an attachable package having said coupling element;

a first compartment selected from said plurality of compartments wherein said first compartment is configured to hold at least a printed item of letter sized or A4 sized paper or folded printed item an integral fractional size of said letter sized or A4 sized paper; and, a second compartment selected from said plurality of compartments wherein said second compartment is configured to hold at least a condiment, napkin, hand-wipe or utensil;

wherein said first compartment or said second compartment is configured to hold a prize that is held within said first compartment or said second compartment, wherein said prize comprises a scratch-off game.

3. A multi-compartment package attachment comprising:

a top portion of plastic;

a bottom portion of plastic wherein said top portion of plastic and said bottom portion of plastic are coupled to each other and wherein said bottom portion comprises a coupling element configured to couple said multi-compartment package attachment to a food package wherein said coupling element is selected from the group consisting of adhesive, static electricity, hook and loop, staples, tape, snaps, buttons, line, string and epoxy;

a plurality of compartments formed between said top portion of plastic and said bottom portion of plastic wherein said plurality of compartments form an attachable package having said coupling element;

a first compartment selected from said plurality of compartments wherein said first compartment is configured to hold at least a printed item of letter sized or A4 sized paper or folded printed item an integral fractional size of said letter sized or A4 sized paper;

a second compartment selected from said plurality of compartments wherein said second compartment is configured to hold at least a condiment, napkin, hand-wipe or utensil; and, a prize held between said bottom portion and said food package.

* * * * *